US011623447B2

(12) United States Patent
Van De Sande

(10) Patent No.: US 11,623,447 B2
(45) Date of Patent: Apr. 11, 2023

(54) MODULAR INK SUPPLY

(71) Applicant: Canon Production Printing Holding B.V., Venlo (NL)

(72) Inventor: Henricus J. A. Van De Sande, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 17/091,099

(22) Filed: Nov. 6, 2020

(65) Prior Publication Data

US 2021/0053350 A1 Feb. 25, 2021

Related U.S. Application Data

(63) Continuation of application No. PCT/EP2019/062093, filed on May 10, 2019.

(30) Foreign Application Priority Data

May 17, 2018 (EP) ..... 18173046

(51) Int. Cl.
*B41J 2/175* (2006.01)
*B41J 11/00* (2006.01)

(52) U.S. Cl.
CPC ..... *B41J 2/175* (2013.01); *B41J 11/002* (2013.01)

(58) Field of Classification Search
None
See application file for complete search history.

(56) References Cited

U.S. PATENT DOCUMENTS

| | | | | |
|---|---|---|---|---|
| 5,570,118 | A | 10/1996 | Rezanka et al. | |
| 7,575,315 | B2 | 8/2009 | Williams et al. | |
| 9,546,070 | B2 | 1/2017 | Hollands et al. | |
| 2003/0202039 | A1* | 10/2003 | Rutland | B41J 11/0015 347/37 |
| 2011/0128337 | A1* | 6/2011 | Muir | B41J 15/165 347/104 |
| 2014/0225945 | A1 | 8/2014 | Herman et al. | |
| 2015/0328907 | A1* | 11/2015 | Regelsberger | B41J 3/60 347/104 |

FOREIGN PATENT DOCUMENTS

| | | | |
|---|---|---|---|
| WO | WO 2008/084691 | A1 | 7/2008 |
| WO | WO 2017/202848 | A1 | 11/2017 |

OTHER PUBLICATIONS

International Search Report (PCT/ISA/210) issued in PCT/EP2019/062093 dated Jun. 24, 2019.
Written Opinion (PCT/ISA/237) issued in PCT/EP2019/062093 dated Jun. 24, 2019.

* cited by examiner

*Primary Examiner* — Alejandro Valencia
(74) *Attorney, Agent, or Firm* — Birch, Stewart, Kolasch & Birch, LLP

(57) ABSTRACT

A printing module includes a first imaging device and a slot for accommodating an optional second imaging device. An ink supply module includes a slot for accommodating an optional drying/fixation apparatus, and a second ink supply device. Also, the ink supply module and the printing module include ink inlet/outlet ports such that the optional second imaging device in the printing module, if present, can be supplied ink from the second ink supply in the ink supply module when the printing module and the ink supply module are combined to form a printer.

3 Claims, 3 Drawing Sheets

MODULAR INK SUPPLY

CROSS REFERENCE TO RELATED APPLICATIONS

This application is a Continuation of PCI International Application No. PCT/EP2019/062093, filed on May 10, 2019, which claims priority under 35 U.S.C. 119(a) to patent application Ser. No. 18/173,046.6, filed in Europe on May 17, 2018, all of which are hereby expressly incorporated by reference into the present application.

FIELD OF THE INVENTION

The present invention relates to a modular printing system, especially a printing system comprising a modular ink supply.

BACKGROUND OF THE INVENTION

In printing or copying systems ink modules are used to supply ink to the imaging devices, e.g. print heads.

In the prior art configurations a separate module is normally used to hold the ink supply. Alternatively, ink tanks can be held in the main printing module of a printing system.

Further, due to the lack of modularity of the ink supply of these prior art configurations, it is needed to provide ink tanks for every printing mode of the printing system, e.g. black and white mode, full-color mode, etc.

In order to overcome the aforementioned problems, the present invention provides a printing system comprising a modular ink supply. The modularity of the ink supply allows including in the printing system exclusively those modules required for a desired printing mode.

SUMMARY OF THE INVENTION

In view of the above, an object of the present invention is to provide a new and improved printing system.

In accordance with the invention, a printing module as recited in claim 1, an ink supply module as recited in claim 3, and a printer as recited in claim 5 are provided. Advantageous or preferred features of the invention are recited in the dependent claims.

A module is usually understood as each of a set of standardized parts or independent units that can be used to construct a more complex structure, such as an item of furniture or a building, as per its definition in Oxford dictionary.

According to one aspect, therefore, the present invention provides a printing module. The printing module comprises a first media transport mechanism. Further, the printing module comprises a first imaging device, e.g. print head. Further, the printing module comprises a slot for accommodating an optional second imaging device. The printing module further comprises a first ink supply device operatively connected to the first imaging device, and a first ink inlet port operatively connected to the optional second imaging device via a first ink supply line.

In this way, the first and second imaging devices can be independently supplied with ink. The first image device is supplied ink through its connection to the first ink supply. In turn, the second imaging device can be supplied ink through the first ink inlet port, when the latter is connected to a second ink supply device of a module different than the printing module.

According to another aspect, the printing module of the present invention further comprises a second imaging device in the slot for accommodating an optional second imaging device, wherein the second imaging device is fluidly connected to the first ink inlet via the first ink supply line. The configuration of the present invention allows introducing a second imaging device in the slot for accommodating a second optional imaging device which is fluidly connected to the first ink inlet via the first ink supply line, i.e. it receives its ink supply through an ink inlet port of the printing module. As a consequence, the modularity of the present invention allows introducing a second imaging device that receives its ink from an ink supply device in a different module than the printing module.

According to another aspect, the present invention provides an ink supply module. The ink supply module comprises a second media transport mechanism. Further, the ink supply module comprises a slot for accommodating a drying/fixation apparatus, e.g. a drying drum or a drying belt. The ink supply module further comprises a second ink supply device, and a first ink outlet port operatively connected to the second ink supply device via a second ink supply line.

As previously mentioned, this configuration allows the first and second imaging devices to be independently supplied with ink. The first image device of the printing module can be supplied ink through its connection to the first ink supply in the printing module. In turn, the second imaging device of the printing module can be supplied ink from the second ink supply through the first ink inlet port of the ink supply module. This modular configuration allows easily providing printing systems including only those modules required for a desired printing mode.

According to another aspect, the present invention provides an ink supply module further comprising a drying/fixation apparatus in the slot for accommodating a drying/fixation apparatus. This configuration allows including a further drying/fixation apparatus in the ink supply module, thereby enhancing the drying capability of the printers in which said ink supply module is included.

According to another related aspect, the present invention provides a printer comprising a printing module according to claim 2, and an ink supply module according to claim 3.

The printer is designed so that the first media transport mechanism and the second media transport mechanism are operatively connected such that in operation a recording medium transported through the first media transport mechanism is consecutively transported through the second media transport mechanism. In this manner, the media printed in the printing module can be subsequently transported in operation through the ink supply module.

Accordingly, if the printer comprises further modules, e.g. an additional Fixation/Drying module, said further modules comprise in turn an additional media transport mechanism though which the media is consecutively transported after the second media transport mechanism in the ink supply module.

The printer is also designed so that the first ink inlet port of the printing module is in fluid connection with the first ink outlet port of the ink supply module such that in operation an ink can flow from the second ink supply device comprised in the ink supply module to the second imaging device comprised in the printing module. This configuration allows the first and second imaging devices to be independently supplied with ink, and allows including in the printing system only those modules required for a desired printing mode, e.g. black and white mode, color mode, etc.

According to another aspect, the present invention provides a printer in which the first ink supply device comprises exclusively ink for printing in a black and white mode, and in which the second ink supply device is omitted. The modularity of the printer system of the present invention allows providing a simple configuration for providing a printer exclusively for black and white printing mode. Full color configurations provide color ink in the second ink supply, allowing a simple configuration for black and white mode, in which the second ink supply is simply omitted, thereby profiting from the modularity of the present invention to provide a printer that allows including only those modules needed for a desired printing mode.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF EMBODIMENTS

Figure 1:
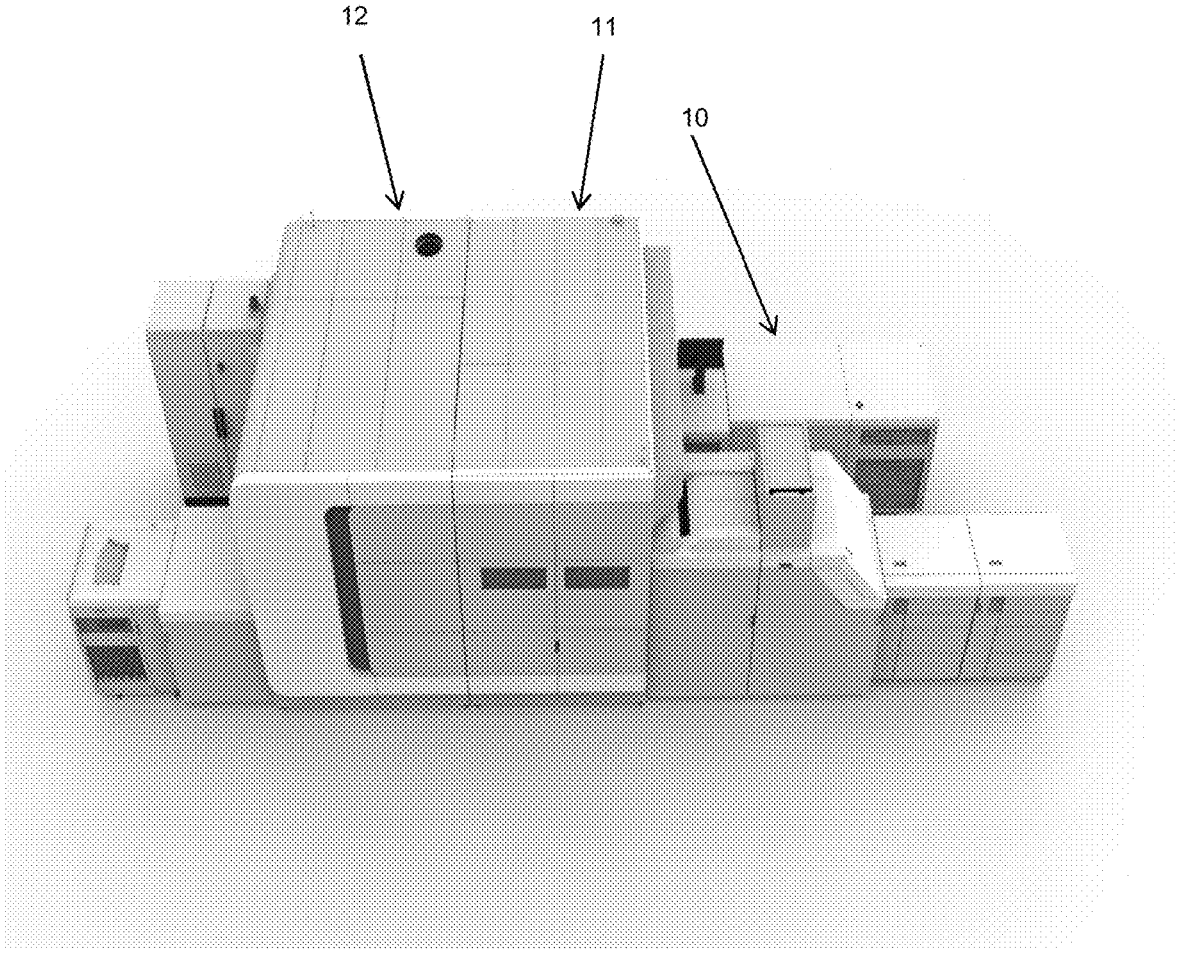
FIG. 1 is a schematic of a state of the art printing device.

With reference firstly to FIG. 1 of the drawings, a schematic of a state of the art printing device is shown. The printer of FIG. 1 shows a separate ink module 10. It can be observed in FIG. 1 that the ink module 10 is independent from the other modules of the printer of FIG. 1, namely a printing module 11 and a drying module 12. This state of the art configuration provides a single ink module 10 that provides ink to the imaging device, e.g. print head, of the printer of FIG. 1. This configuration has the implication that a complete catalog of inks, needed to fulfill the needs of a plurality of printing modes, must be loaded into the ink module 10.

Alternative state of the art printing devices are known. Alternative state of the art configurations provide an alternative configuration of an ink module to provide ink to the imaging device, e.g. print head, of a printer. It has the characteristic that all the ink tanks needed are provided inside the printing module. This configuration also has the characteristic that a complete catalog of inks, needed to fulfill the needs of a plurality of printing modes, must be loaded into the ink tanks of the printing module.

Figure 2:
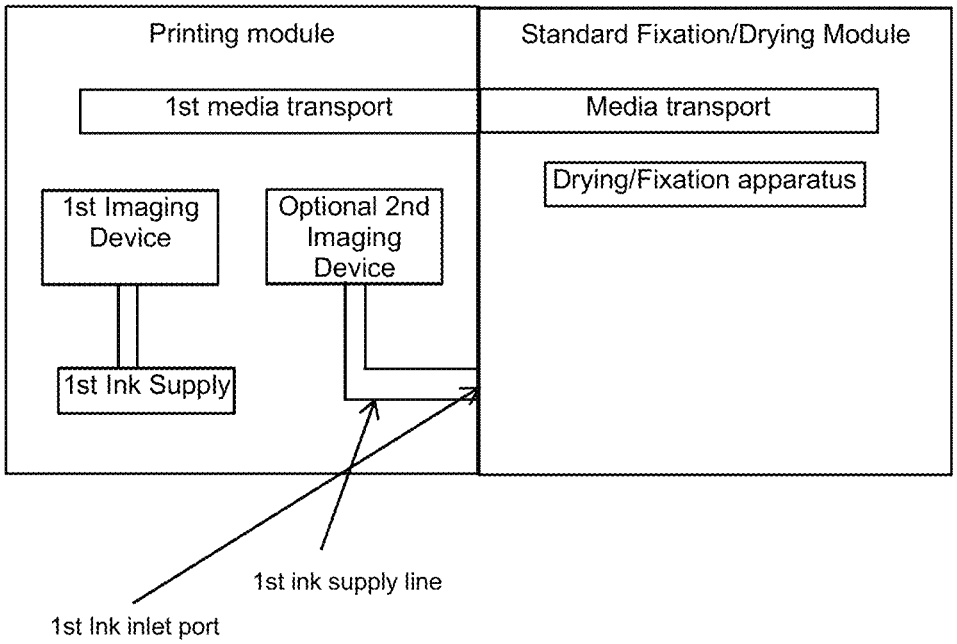
FIG. 2 is a schematic view of one possible configuration of the printer of the present invention.

With reference to FIG. 2 of the drawings, a schematic view of one of the possible configurations of the printer of the present invention is shown.

The configuration shown in FIG. 2 is characterized by the presence of a printing module comprising a first imaging device operatively connected to a first ink supply, and a first media transport mechanism. In the configuration shown in FIG. 2 there is no second imaging device in the slot for accommodating an optional second imaging device. As it can be observed in FIG. 2, the printing module comprises an ink supply line and a first ink inlet port connecting the slot for accommodating an optional second imaging device to the exterior of the printing module. In a particular embodiment, the first ink supply in the printing module can be used for storing black ink, as well as other liquids required by the printer as maintenance liquids and/or primer.

As it can be observed in FIG. 2, the modularity provided by the present invention allows providing a simple configuration which can be expanded for a plurality of other printing modes by adding an additional second imaging device in the printing module, and an additional ink supply module, as it is shown below with reference to FIG. 3.

In the case, for example, of a black and white printing mode, the modularity provided by the present invention allows combining the printing module of the represent invention with an ink supply module that comprises no ink supply, thereby providing a customizable printer whose complexity can be easily adapted to the printing mode needed.

Figure 3:
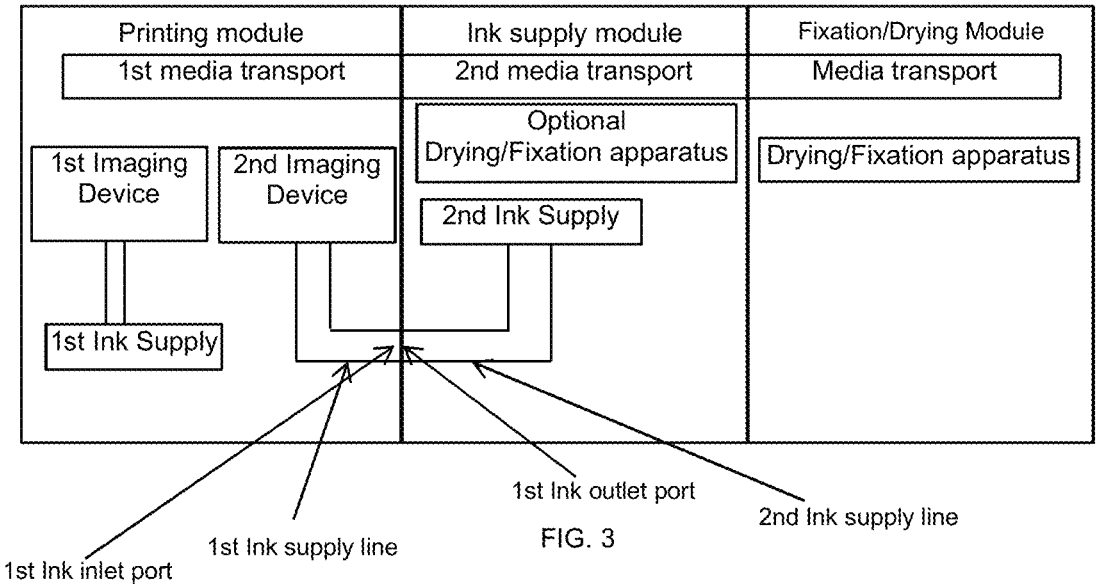
FIG. 3 is a schematic view of another possible configuration of the printer of the present invention.

With reference to FIG. 3 of the drawings, a schematic view of a configuration of the printer of the present invention is shown. The printer of FIG. 3 shows a first ink supply in the printing module and a second ink supply in an ink supply module.

In the configuration shown in FIG. 3 the first ink supply is operatively connected to the first imaging device of the printer of FIG. 3 while the second ink supply is operatively connected to the second imaging device of the printer of FIG. 3. In a particular configuration, the first modular ink supply may comprise the black ink needed for black and white mode as well as any other fluids required by the printer of the present invention. The second ink supply may comprise the plurality of color inks needed for full color mode by the printer of the present invention.

In the configuration shown in FIG. 3, the second imaging device receives ink through a first ink inlet port. In turn, said first ink inlet port is configured such that in operation an ink can flow from the second ink supply device comprised in the ink supply module to the second imaging device comprised in the printing module through said first ink inlet port via an ink supply line. The configuration shown in FIG. 3 profits from the modularity provided by the present invention by providing a printer for a plurality of printing modes simply by introducing an additional ink supply module comprising a second ink supply. Additionally, the printer configuration in FIG. 3 comprises a slot for accommodating an optional drying/fixation apparatus which allows increasing the drying capabilities for particular printing modes.

Figure 4:
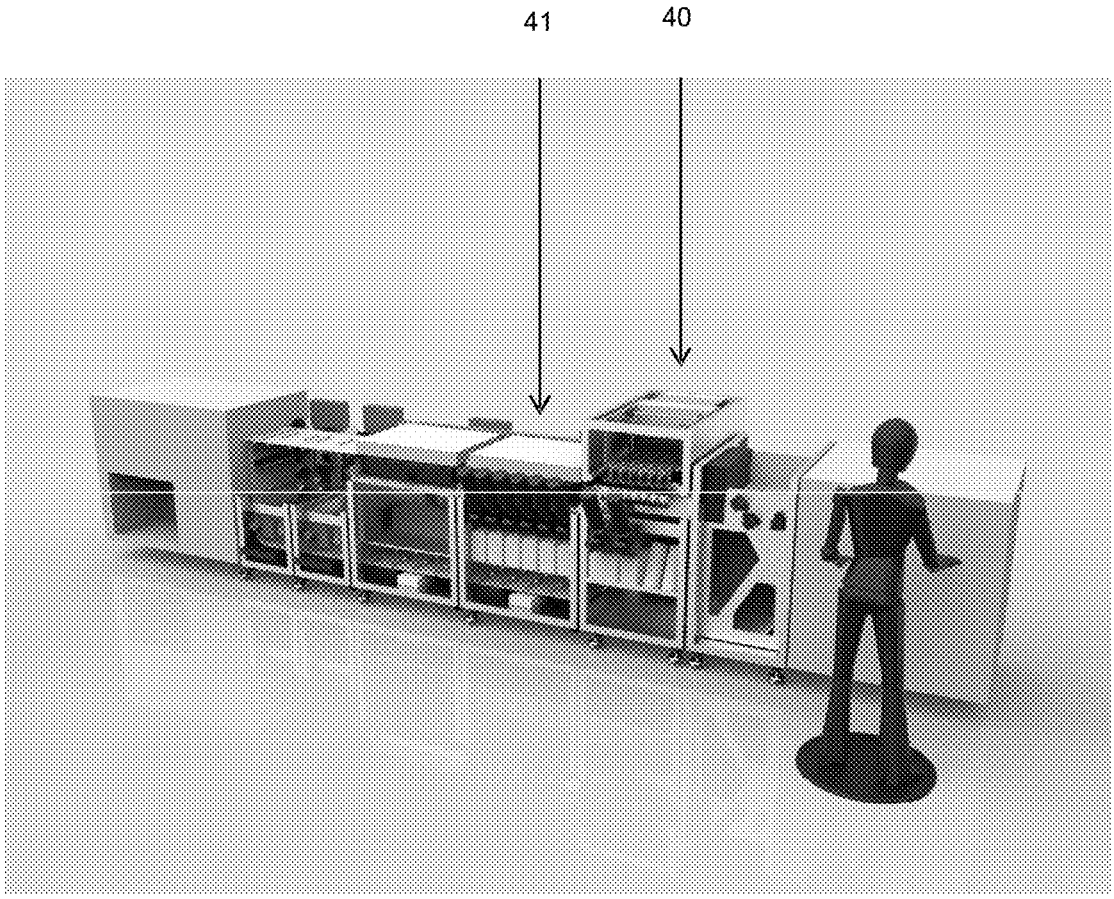
FIG. 4 is a schematic view of the printer of the present invention.

With reference to FIG. 4 of the drawings, a schematic view of the printer of the present invention for a black and white printing mode is shown. The printer of FIG. 4 shows a first ink supply and a second ink supply.

It should be noted that the printer of FIG. 4 shows a similar configuration presented in FIG. 3 but with the different modules ordered from right to left.

The configuration shown in FIG. 4 is characterized by the presence of said first ink supply and second ink supply, wherein the first ink supply is operatively connected to the first imaging device of the printing module 40 of FIG. 4 while the second ink supply is operatively connected to the second imaging device of the printing module 40 of FIG. 4. In the configuration shown in FIG. 4, the second imaging device receives ink through a first ink inlet port. In turn, said first ink inlet port is configured such that in operation an ink can flow from the second ink supply device comprised in the ink supply module 41 to the second imaging device comprised in the printing module 40 through said first ink inlet port.

The configuration shown in FIG. 4 allows leaving out the second ink supply device, thereby providing the advantage that depending upon the printing mode selected, a simpler configuration can be provided. In the case, for example, of a black and white printing mode, the modularity provided by the present invention allows skipping the presence of ink in the second ink supply device, thereby providing a customizable printer whose complexity can be easily adapted to the printing mode needed.

Although specific embodiments of the invention are illustrated and described herein, it will be appreciated by those of ordinary skill in the art that a variety of alternate and/or equivalent implementations exist.

It will be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The invention claimed is:

1. A system including a printing module and an ink supply module, wherein the printing module includes:

a first imaging device connected to a first ink supply device;

a second imaging device including a first ink supply line and provided without an ink supply device, a first media transport mechanism; and a first ink inlet port operatively connected to the second imaging device via the first ink supply line, wherein the ink supply module includes:

a second media transport mechanism;

a slot for accommodating a drying/fixation apparatus;

a second ink supply device; and a first ink outlet port operatively connected to the second ink supply device via a second ink supply line, and wherein the ink supply module is independent from the printing module.

2. The system of claim 1, further comprising the drying/fixation apparatus in the slot of the ink supply module.

3. The system according to claim 1, wherein the second imaging device is fluidly connected to the second ink supply device via the first ink inlet port, and wherein the ink supply module supplies ink from the second ink supply device, through the second ink supply line and then through the first ink supply line to the second imaging device.

* * * * *